United States Patent [19]

Noe

[11] 4,253,383

[45] Mar. 3, 1981

[54] LABELLED FABRIC, A METHOD AND AN ARRANGEMENT FOR MAKING A LABELLED FABRIC

[76] Inventor: Manfred Noe, Arthur-Grimm-Weg 28, 6933 Mudau, Fed. Rep. of Germany

[21] Appl. No.: 7,408

[22] Filed: Jan. 29, 1979

[51] Int. Cl.[3] ..... B31B 19/00

[52] U.S. Cl. ..... 493/200; 493/224; 156/292; 156/324; 156/515; 428/247; 428/252; 493/288; 493/297; 493/264; 493/267

[58] Field of Search ..... 156/308, 324, 292, 515, 156/583.5; 428/36, 109, 110, 111, 238, 239, 246, 247, 252, 255; 93/DIG. 1, 33 H, 35 R, 35 MW

[56] References Cited

U.S. PATENT DOCUMENTS

| | | | |
|---|---|---|---|
| 2,851,389 | 9/1958 | Lappala | 428/247 |
| 3,616,130 | 10/1971 | Rogosch et al. | 428/110 |
| 3,629,047 | 12/1971 | Davison | 428/247 |
| 3,629,048 | 12/1971 | Davison | 428/110 |
| 3,700,536 | 10/1972 | Bontvelzen et al. | 428/110 |
| 3,791,267 | 2/1974 | Brooks | 93/35 R |
| 3,871,910 | 3/1975 | Barkes et al. | 428/247 |
| 3,910,810 | 10/1975 | Roos | 93/DIG. 1 |
| 4,106,261 | 8/1978 | Greenwalt | 156/324 |

FOREIGN PATENT DOCUMENTS

| | | | |
|---|---|---|---|
| 50-7182 | 3/1975 | Japan | 428/247 |

*Primary Examiner*—James J. Bell
*Attorney, Agent, or Firm*—Michael J. Striker

[57] ABSTRACT

A labelled fabric includes a wide-mesh fabric having two opposite surfaces, a first web which is guided against one of the opposite surfaces of the wide-mesh fabric and a second web which is guided against the other of the opposite surfaces of the wide-mesh fabric. The second web is provided with labelling indicia. The first and second webs are bonded to one another through the interstices of the wide-mesh fabric.

11 Claims, 2 Drawing Figures

LABELLED FABRIC, A METHOD AND AN ARRANGEMENT FOR MAKING A LABELLED FABRIC

BACKGROUND OF THE INVENTION

The present invention relates to labelled fabrics. More particularly, the present invention concerns methods of and arrangements for making labelled fabrics for the manufacturing of bags.

It is known in the prior art to provide bags, manufactured on a Raschel knitting machine, with labels. It is also known to provide a pressing guide which presses a web provided with labelling indicia against a basic fabric. The web is provided with an adhesive substance. Thus, the web is glued with its adhesive side onto the basic fabric. The labelled side of the web, when the same is pressed against the basic fabric, faces away from the basic fabric. Such an arrangement has the disadvantage that the pressing guide can become welded to the labelling web, especially if the labelling web and the pressing guide are both of synthetic plastic material.

The above-described arrangement requires an additional device for controlling the position of the basic fabric relative to the pressing guide no matter whether it is necessary or not to subsequently apply the labels onto the finished bags.

SUMMARY OF THE INVENTION

It is a general object of the present invention to avoid the disadvantages of the prior art arrangements for and methods of making a labelled fabric.

More particularly, it is an object of the present invention to provide a new type of a labelled fabric, and a method of and arrangement for making such a labelled fabric.

Another object of the present invention is to provide such an arrangement for making a labelled fabric, which does not require either any pressing guides or any additional controlling devices for regulating position of the pressing guide relative to the basic fabric.

In pursuance of these objects and others which will become apparent hereafter, one feature of the present invention resides in providing a labelled fabric which comprises a wide-mesh fabric having two opposite surfaces, a first web located against one of said surfaces and a second web which is provided with labelling indicia and located against the other of said surfaces of the wide-mesh fabric. The second web is bonded to the first web through the interstices of said wide-mesh fabric.

The method of making this labelled fabric includes the steps of producing a wide-mesh fabric which has two opposite surfaces; guiding a first web against one of said surfaces and guiding a second web which is provided with labelling indicia against the other of said surfaces. The webs are bonded to one another through the interstices of said wide-mesh fabric.

In accordance with another advantageous feature of the present invention an arrangement for making a labelled fabric comprises means for producing a wide-mesh fabric which has two opposite surfaces, first means for guiding a first web against one of said surfaces and a second means for guiding a second web provided with labelling indicia against the other of said surfaces. There are further provided means for bonding said webs to one another through the interstices of said wide-mesh fabric.

The first and second webs can be glued or welded together. In accordance with a preferred embodiment of the present invention the first web is guided against the one surface of the wide-mesh fabric before they encounter the second web which is provided with labelling indicia. At a predetermined point the second web is guided against the other surface of the wide-mesh fabric. However, it is to be understood that the first and second webs may be guided simultaneously against the respective opposite surfaces of the wide-mesh fabric.

The method of making the labelled material in accordance with the present invention does not require any complicated additional devices for binding the base fabric (i.e., the wide-mesh fabric), rather comparatively simple guiding elements for guiding for example the second web and the wide-mesh fabric.

In accordance with the present invention it is possible to simultaneously manufacture two such labelled fabrics which extend parallel to each other. When the separate fabrics are finished, they can be connected to each other so as to form a tube which can be cross-seamed to constitute a continuous row of labelled bags. This continuous row can then be separated into separate labelled bags. The cross-seaming of the tube may be carried out by pressing or welding rollers which can be mounted on a Raschel knitting machine.

The first web may be provided on one side thereof with an adhesive (e.g. reactive adhesive). Thus, the first and second webs may be connected by pressing one onto another and/or by heating the adhesive.

In accordance with the present invention the labels are located precisely and symmetrically relative to the middle of the corresponding bags. In other words, there is no danger that one label will be placed partially on one bag and partially on the adjacent one.

In order to ensure the correct crosswise connection of the first and second fabrics, the second webs are provided on the labelling side thereof with marking lines. The two labelled fabrics are guided parallel to each other through a predetermined region of the arrangement where they are connected to each other. Later, thusly connected fabrics are divided into separate bags so that one vertical seam serves as a connecting web for each two adjacent bags. The interconnecting seam is stipulated by the respective marking line provided on the labelling side of the second webs. Such a regulation ensures that the labels are always located symmetrically on each bag of the continuous bag path and by no means are displaced relative to the middle of each separate bag.

The marking line can be advantageously located on the edge of the end portion of each of the labels which together constitute the second continuous web. The marking line is detected by a sensing device which is coupled with an adjusting device. The adjusting device in its turn is connected to the means for producing said wide-mesh fabric. Thus, the sensing device sends a signal, corresponding to actual movement of the second web, onto the adjusting device and the latter adjusts the wide-mesh fabric producing means if so necessary. The adjusting device may also be coupled with the means for guiding the second web to thereby adjust movement of the same (i.e., to cause slippage or expansion of the second web) in response to the signal received from the sensing device.

The sensing device may be an electrooptically operated non-contact sensor.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
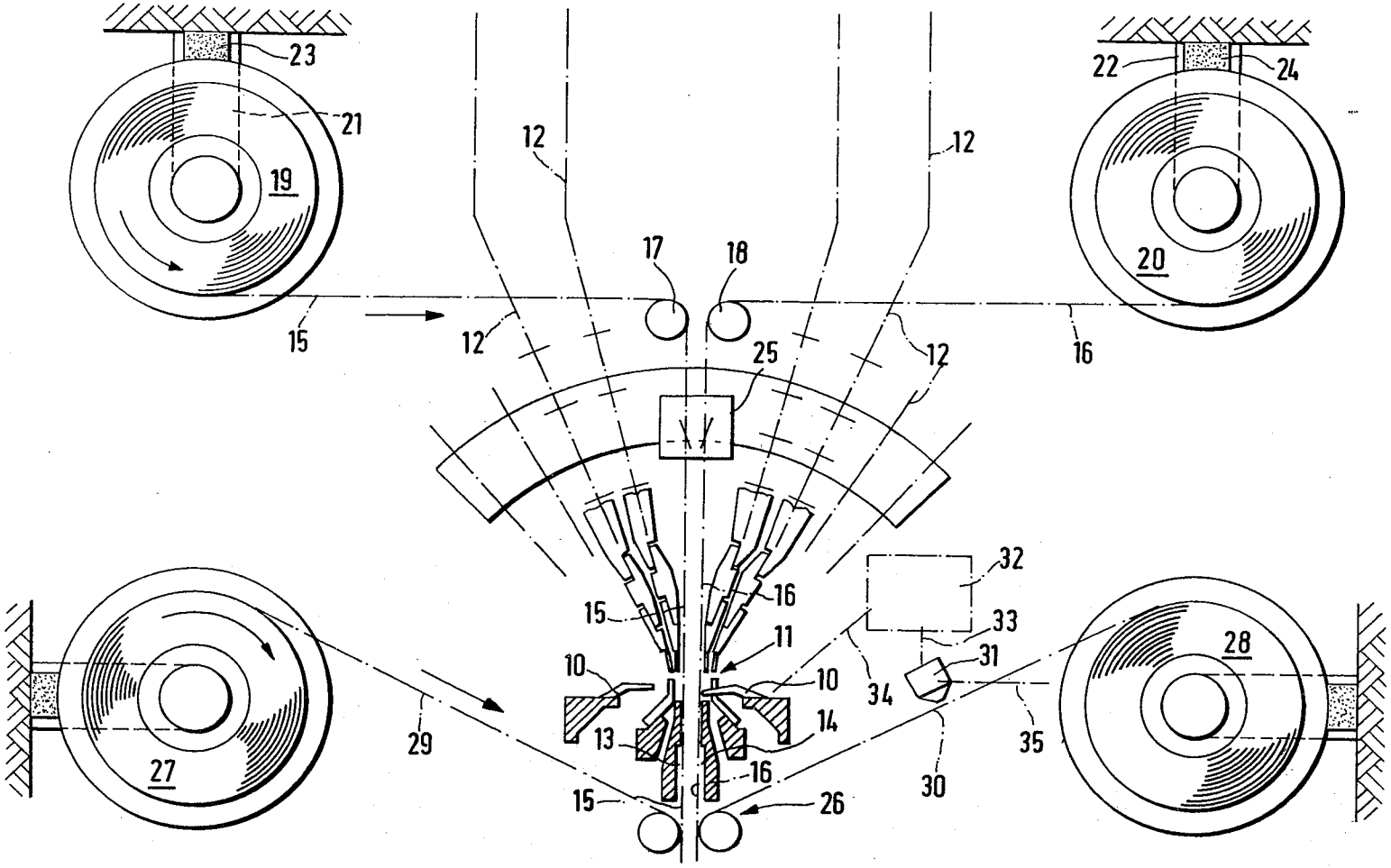
FIG. 1 is a schematic view of an arrangement for making a labelled fabric in accordance with the present invention.
Figure 2:
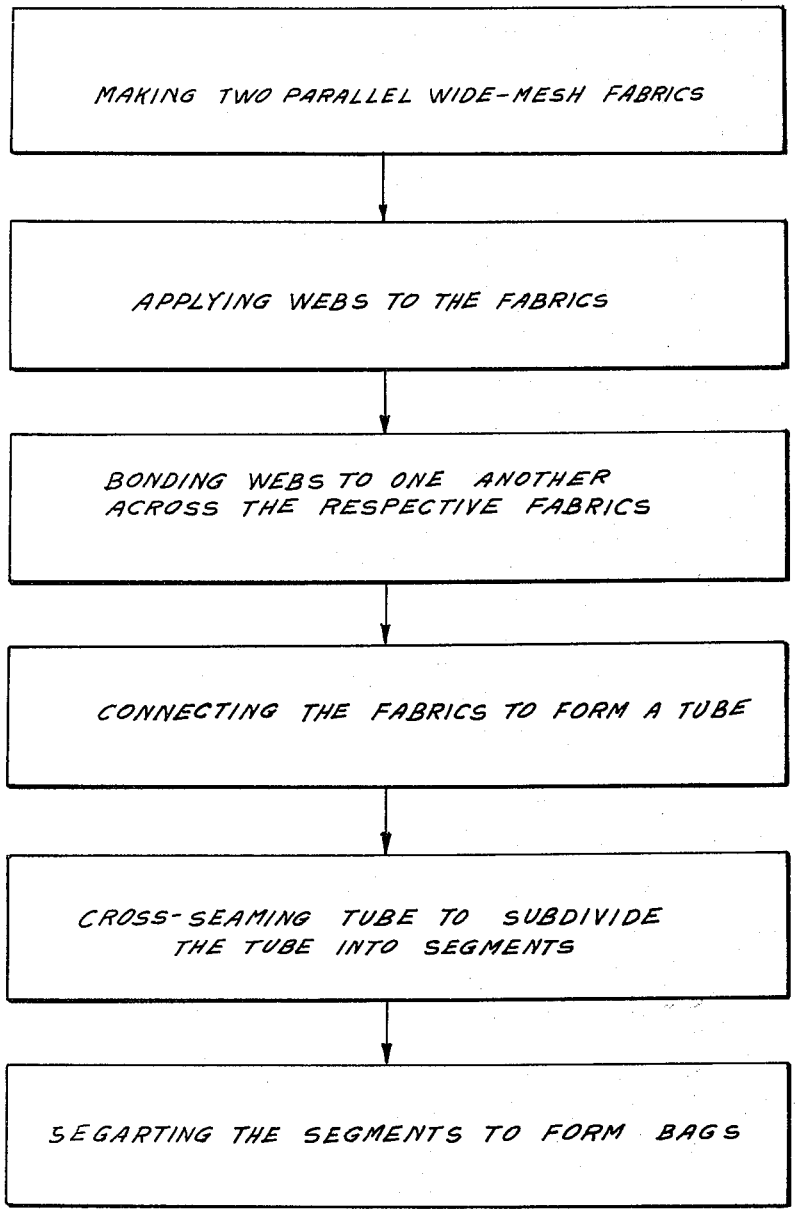
FIG. 2 is a flow diagram, showing the steps of manufacturing bags from the labelled fabric.

Referring now to FIGS. 1 and 2 of the drawings, it may be seen that the reference numeral 10 designates a number of tools 10 located in a working area 11 of an arrangement. A plurality of separate continuous fibers 12 of synthetic plastic material is guided into the working area 11. The separate fibers 12 are arranged in the area 11 into a plurality of webs (FIG. 1 shows only two such webs) which together constitute two parallel wide-mesh fabrics 13 and 14 which define the both sides of bags. Later the fabrics 13 and 14 are so connected to each other as to constitute together a continuous succession of bags. The succession is then divided (e.g. thermally) into a plurality of successive separate bags (see FIG. 2).

Two adhesive webs 15 and 16 of synthetic plastic material are guided together with separate fibers 12. One side of each of the webs 15 and 16 is provided with a self-adhesive layer. The webs 15 and 16 are guided through guide rollers 17 and 18, respectively, from the respective spools 19 and 20. The spools 19 and 20 are rotatably mounted on respective supports 21 and 22. The rotation of the spools 19 and 20 are respectively operated by brake clutches 23 and 24. The adhesive sides of the webs 15 and 16 respectively face outwardly away from the outer surface of the guide rollers 17 and 18. A box 25 is provided downstream of the guide rollers 17 and 18 so as to twist the webs 15 and 16 to thereby arrange the adhesive side of the webs 15 and 16 facing towards the wide-mesh fabrics 13 and 14, respectively.

Both webs 15 and 16 are so guided in the working area 11 as not to engage the respective tools 10. The webs 15 and 16 are guided parallel to the respective wide-mesh fabrics 13 and 14 at the respective inner surfaces thereof (see FIG. 1), until they arrive at a pressing roller 26. Two webs 29 and 30, each provided with labelling indicia, are also guided onto the pressing roller 26. The webs 15 and 16 may have the width different from that of the webs 29 and 30. Each labelling web 29 and 30 is guided parallel to the outer surface of the corresponding wide-mesh fabric 13 and 14, i.e., the surface opposite to that adjacent to the corresponding web 17 and 18, respectively. In the working area of the pressing roller 26 the outer labelling webs 29 and 30, the wide-mesh fabrics 13 and 14 and both inner webs 15 and 16 are pressed against each other respectively, so that the self-adhesive layer of the inner web 15 passes through the interstices of the wide-mesh fabric 13 and engage (i.e. glues to) the outer labelling web 29. Thus the labelling web 29 becomes connected to the inner web 15. Simultaneously, the other labelling web 30 becomes connected to the inner web 16 through the interstices of the wide-mesh fabric 14.

The arrangement is further provided with a patterning (i.e., adjusting) mechanism which is shown schematically in FIG. 1. The pattering mechanism is operatively connected to the tools 10 (see the dash-dot line 34). The patterning mechanism operates the tools 10 so that both wide-mesh fabrics 13 and 14 extend parallel and are spaced from each other until they arrive to a predetermined point were the fabrics 13 and 14 are connected to each other.

The patterning mechanism is actuated by a signal from an electrooptic scanning arrangement 31 (i.e. sensor) which is operative in its turn in response to a marking sign located on the edge of the labelling web 30.

Should both sides of the bags be labelled (see FIG. 1), it is possible to install another scanning arrangement 31 for scanning the labelling web 39. Should it be the case, then both signals (i.e., the corresponding signals from both sensors) are transmitted onto an adjusting device 32 of the patterning mechanism so as to compare both signals and issue a resulting signal to adjust one or another element of the arrangement to thereby eliminate the possible discrepancy in the signals obtained from the separate scanning arrangements. The functional connection of the sensor 31 and the adjusting device 32 is shown in FIG. 1 by the dash-dot line 33. The sensor 31 and the adjusting device 32 may also be functionally connected to a drive (not shown) of a magazine roll 28 loaded with the labelling web 30. This connection is shown in FIG. 1 by a dash-dot line 35.

By a combined adjustment of the tools 10 and the drive of at least one of the two magazine rolls 27 and 28 it is possible to maintain the tact stroke of the patterning mechanism within a relatively narrow range and what is especially advantageous to synchronize the supply of the labelling webs 29 and 30. Thus, the labelling webs 29 and 30 are continuously guided directly against the outer surfaces of the wide-mesh fabrics 13 and 14, respectively, where the webs 15 and 16 are connected (i.e. glued or welded) to the labelling webs 29 and 30, respectively, through the interstices of the wide-mesh fabrics 13 and 14.

Eventually the continuous path of the bags is divided into a plurality of separate labelled bags. The above described method of making the labelled bags is shown diagrammatically in FIG. 2. The division is carried out by a cutting arrangement, which is conventional and therefore is not shown for the sake of simplicity of the drawing. The continuous path of the labelled fabric is divided so that the dividing seam extends along the middle of the wide-mesh fabric. The whole arrangement works continuously.

The webs 15 and 16 do not have to have any adhesive layers. Should it be the case, then the pressing roller 26, which is operative for both wide-mesh fabrics 13 and 14, may be a welding roller which welds the webs 15 and 16 to the labelling webs 29 and 30, respectively. In this case, the twisting arrangement 25 may be eliminated.

It will be understood that each of the elements described above, or two or more together, may also find a useful application in other types of a labelled fabric, a method for and an arrangement of making this labelled fabric differing from the types described above.

While the invention has been illustrated and described as embodied in a labelled fabric, a method for and an arrangement of making this labelled fabric it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of manufacturing bags of a labelled fabric, comprising the steps of producing wide-mesh fabric having two opposite surfaces; positioning at least two wide-mesh fabrics in simultaneous advanced movement parallel to each other; guiding at least two first webs between said two wide-mesh fabrics, each first web being guided against one surface of the corresponding wide-mesh fabric; guiding at least two second webs provided with labelling indicia, each parallel to and against said other surface of the respective wide-mesh fabric; bonding each one of said two first and second webs to each other through the interstices of said wide-mesh fabrics so as to form two parallel labelled fabrics; connecting said two parallel labelled fabrics to each other in one continuous two-sides labelled material; cross-seaming said two-sided labelled material to subdivide said material into segments; and dividing said material into a plurality of separate bags having two labelled sides.

2. A method defined in claim 1, wherein said bonding step constitutes the step of gluing said webs to one another.

3. A method defined in claim 1, wherein said bonding step constitutes the step of welding said webs to one another.

4. A method defined in claim 2; and further comprising the step of applying adhesive on one of said webs.

5. A method defined in claim 4, wherein said adhesive is applied onto at least one side of said first webs.

6. A method defined in claim 2; and further comprising the step of pressing said webs against each other.

7. A method defined in claim 1; and wherein producing a wide-mesh fabric further comprising the step of guiding a plurality of separate fibers constituting together said wide-mesh fabric.

8. A method defined in claim 1; and further comprising the step of marking at least one of said second webs with a plurality of marks spaced one from another in a direction of guiding said second web by a distance constituting the width of a bag.

9. A method defined in claim 8, wherein said material is divided into said plurality of the bags along said marks.

10. A method defined in claim 9, wherein said labelling indicia on said second web constitutes a plurality of separate labels, provided on one side of said second web, facing away from said other surface.

11. A method defined in claim 10, wherein each mark is located on an edge of said second web and at an end portion of each of the separate labels constituting together said second web.

* * * * *